US006651317B2

(12) United States Patent
Pedimonte

(10) Patent No.: US 6,651,317 B2
(45) Date of Patent: Nov. 25, 2003

(54) METHOD FOR PRODUCING AN ELECTRICAL RIBBON CABLE

(75) Inventor: Andreas Pedimonte, Weiden (DE)

(73) Assignee: Nexans, Paris (FR)

( * ) Notice: Subject to any disclaimer, the term of this patent is extended or adjusted under 35 U.S.C. 154(b) by 143 days.

(21) Appl. No.: 09/988,284

(22) Filed: Nov. 19, 2001

(65) Prior Publication Data

US 2002/0062558 A1 May 30, 2002

(30) Foreign Application Priority Data

Nov. 20, 2000 (DE) ..... 100 57 479

(51) Int. Cl.[7] ..... H01R 43/00
(52) U.S. Cl. ..... 29/825; 29/828; 29/592.1
(58) Field of Search ..... 29/611, 825, 861, 29/859, 828, 874, 877, 878, 592.1; 156/148, 73.1, 179, 301, 300; 228/110.1, 111

(56) References Cited

U.S. PATENT DOCUMENTS 4,589,942 A * 5/1986 Korinek ..... 29/825
4,935,170 A * 6/1990 Capol ..... 29/428
5,561,266 A * 10/1996 Okamoto et al. ..... 174/72 R
5,762,507 A * 6/1998 Mochizuki et al. ..... 439/164
6,089,438 A * 7/2000 Suzuki et al. ..... 228/1.1
6,213,377 B1 * 4/2001 Schwerdtle et al. ..... 228/110.1
6,222,131 B1 * 4/2001 Schilson ..... 174/117
6,299,721 B1 * 10/2001 Poutasse et al. ..... 156/278

* cited by examiner

*Primary Examiner*—Carl J. Arbes
*Assistant Examiner*—Tai V Nguyen
(74) *Attorney, Agent, or Firm*—Sughrue Mion, PLLC

(57) ABSTRACT

A method for producing an electrical ribbon cable wherein at least two bare electrical conductors are arranged in parallel and spaced at a distance from each other between two foils of an insulating material that are firmly joined together while enclosing the conductors and fixing them in position. To save the costly adhesive that is typically used, the two foils are ultrasonically welded to each other and to the conductors.

5 Claims, 1 Drawing Sheet

METHOD FOR PRODUCING AN ELECTRICAL RIBBON CABLE

This application is based on and claims the benefit of German Patent Application No. 10057479.3 filed Nov. 20, 2000, which is incorporated by reference herein.

BACKGROUND OF THE INVENTION

The invention relates to a method for producing an electrical ribbon cable, wherein at least two bare electrical conductors are arranged in parallel and spaced at a distance from each other between two foils of an insulating material that are firmly joined together while enclosing the conductors and fixing them in position, e.g., as disclosed in Examined German application DE-AS 26 43 838.

Ribbon cables are preferred in wiring technology particularly because of their low height, which is essentially determined only by the conductors. They take up little space and are very simple to install. This is advantageously true particularly if the conductors are flat conductors with a rectangular cross section. The corresponding cables are referred to as flat conductor cables (FCC). Due to their good electrical and mechanical properties and low space requirements, these flat ribbon cables are also used in airbag cassettes for power and signal transmission between fixed and movable parts of motor vehicles.

In all cases, the flat ribbon cables—hereinafter referred to as "FCCS" for short, which should be understood to include all possible variations—are produced in a laminating process according to the above-cited DE-AS 26 43 838. In a continuous process, for instance two foils of an insulating material provided with an adhesive layer on one side are brought to at least two electrical conductors that are guided in parallel to each other and are joined under pressure while simultaneously being heated. In the finished FCC, the two foils are firmly joined to each other and to the conductors while enclosing the conductors and fixing them in position. This requires a sufficient amount of adhesive applied to the entire width and length of the FCC and determines the production costs of the FCCs to a very substantial degree. The adhesive furthermore contains substances that are toxic and difficult to dispose of.

SUMMARY OF THE INVENTION

The object of the invention is to configure the initially described process in such a way that an FCC can be produced at low cost without impairing its mechanical and electrical properties.

According to the invention, this object is attained by ultrasonically welding the two foils together.

This process makes it possible to produce an FCC in a particularly simple and cost effective manner. Two foils of a suitable insulating material simply need to be joined to enclose the conductors, which are guided parallel to each other, and fed to an ultrasonic welding unit in a continuous process. In this ultrasonic welding unit, the foils are welded to each other and, in a preferred embodiment, also to the conductors in order to form a firmly bonded unit—the FCC. In principle, no adhesive is required. This makes it possible significantly to lower the production costs of the FCC. Substances that are difficult to dispose of are not being used.

It may be advantageous to use an adhesion promoter to enhance the ultrasonic coupling. Such an adhesion promoter, which reacts to ultrasound, may be applied prior to welding, for instance to the surface of the conductors and/or as an extremely thin film to at least one of the foils.

BRIEF DESCRIPTION OF THE DRAWINGS

The method according to the invention will now be described in greater detail with reference to the exemplary embodiments depicted in the drawings in which.

DETAILED DESCRIPTION OF THE INVENTION

Figure 1:
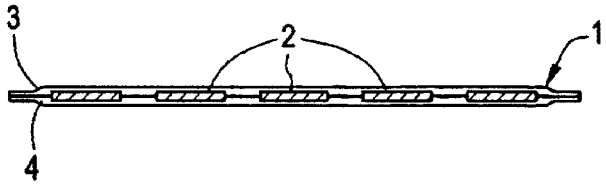
FIG. 1 is a cross section through an FCC produced by the method according to the invention.

As shown in FIG. 1 the FCC 1 has five flat conductors 2 with a rectangular cross section. These flat conductors are arranged in parallel and spaced at a distance from each other within the FCC 1. The insulation of the FCC 1 consists of two foils 3 and 4 that are firmly joined together and to the conductors 2 by means of ultrasonic welding. The FCC 1 is produced as follows, for instance:

Two foils 3 and 4 of an insulating material are continuously pulled off from coils 5 and 6 in the direction of the arrows. They are supplied to two deflection rollers 7 and 8 to which conductors 2 are supplied simultaneously. The gap between the deflection rollers 7 and 8 is advantageously dimensioned such that foils 3 and 4 and conductors 2 are brought together as closely as possible. In the pull-off direction of foils 3 and 4 and conductors 2 as indicated by arrow P, an ultrasonic welding unit 9 is disposed downstream from deflection rollers 7 and 8 in which the foils 3 and 4 are firmly welded to each other and to the conductors 2. In principle, the use of an adhesive is not required. In the ultrasonic welding unit 9, components with a profile corresponding to the profile of the FCC 1 to be produced can be used as the sonotrode and the anvil. The conductors 2 may also be preheated prior to being joined with foils 3 and 4. The finished FCC 1 can then be wound onto a coil 10 or fed directly to a further processing unit.

Figure 2:
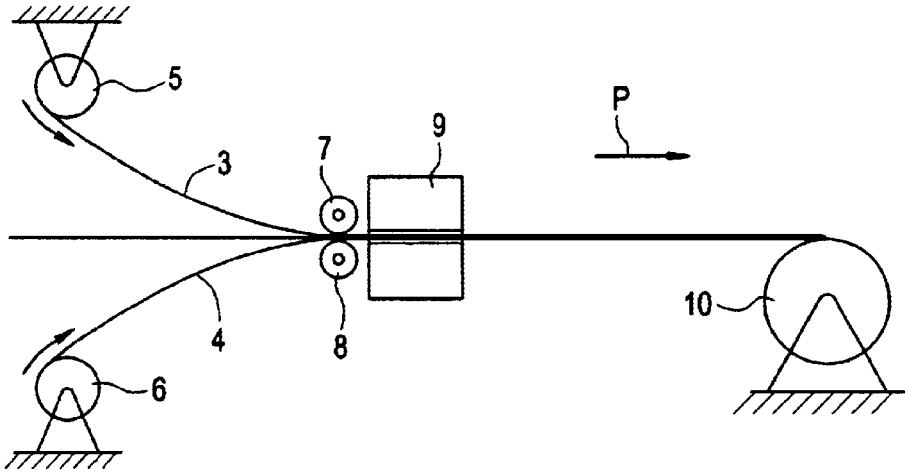
FIG. 2 is a schematic representation of a device to implement the method.
Figure 3:
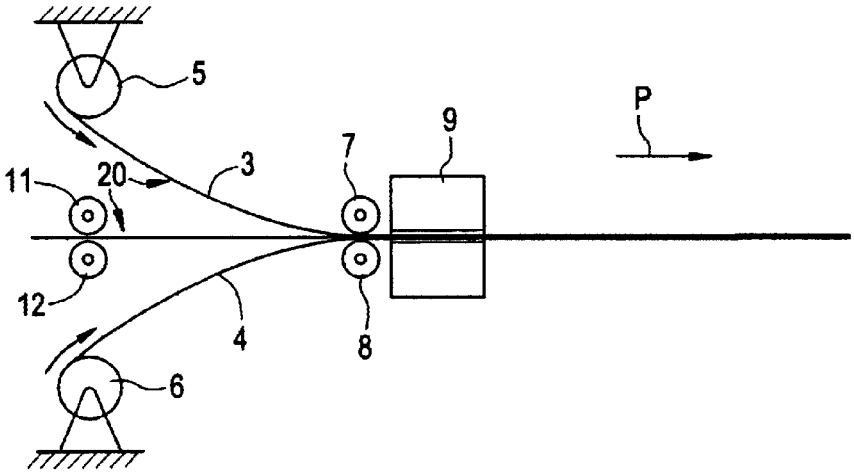
FIG. 3 is an embodiment of a device which is a further improved version of the device in FIG. 2.

If the materials selected for electrical or mechanical reasons for foils 3 and 4 cannot be firmly ultrasonically welded together with conductors 2 it is advantageous to apply an adhesion promoter to the conductors 2 prior to welding. This may be accomplished, for instance, by means of two rollers 11 and 12 as shown in FIG. 3 between which the conductors 2 are guided. The remaining structure of the device according to FIG. 3 is identical to that shown in FIG. 2.

It may also be advantageous to apply a film that is very thin in proportion to the thickness of the foil itself to at least one of foils 3 and 4 as an adhesion promoter for the ultrasonic welding, e.g., as shown at 20 in FIG. 3. It may be advantageous to use two-layer foils in which the layer facing the conductors 2 is suitable for ultrasonic welding.

The foils 3 and 4 consist, for instance, of polyethylene, a polyethylene terpolymer, polyamide or polystyrene. In a preferred embodiment, these foils are between 0.023 mm and 0.1 mm thick. Possible adhesion promoters are, for instance, epoxy resin and polyurethane with a film thickness of between 1.0 $\mu$m and 50 $\mu$m.

What is claimed is:

1. A method for producing an electrical ribbon cable in which at least two bare electrical conductors are arranged in parallel and spaced at a distance from each other between two foils of an insulating material which are firmly joined together by ultrasonic welding while enclosing the conductors and fixing the conductors in position, said method further comprising the step, prior to welding, of disposing an adhesion promoter, which is of a composition different from the insulating materials of said two foils and which reacts to ultrasound, between at least one of the foils and the conductors.

2. A method as claimed in claim 1, wherein at least one of the foils (3,4) is provided with a film, which is very thin in proportion to a thickness of the foil, to serve as the adhesion promoter.

3. A method as claimed in claim 1, wherein the adhesion promoter is applied only to a surface of the conductors (2).

4. A method as claimed in claim 1, wherein said material of said adhesion promoter is selected from the group consisting of epoxy resin and polyurethane.

5. A method as claimed in claim 4, wherein said adhesion promotor comprises a film of a thickness between 1.0 $\mu$m and 50 $\mu$m.

* * * * *